US007406901B2

(12) United States Patent
Schmidt et al.

(10) Patent No.: US 7,406,901 B2
(45) Date of Patent: Aug. 5, 2008

(54) AUTO SHEET THREADING AND CUTTING DEVICE AND METHOD

(75) Inventors: Michael Alan Schmidt, Alpharetta, GA (US); Paul Kerner Pauling, Appleton, WI (US); Joel Andrew Cowden, Lebanon, TN (US)

(73) Assignee: Kimberly Clark Worldwide, Inc., Neenah, WI (US)

( * ) Notice: Subject to any disclaimer, the term of this patent is extended or adjusted under 35 U.S.C. 154(b) by 1091 days.

(21) Appl. No.: 10/027,467

(22) Filed: Dec. 20, 2001

(65) Prior Publication Data

US 2003/0115996 A1 Jun. 26, 2003

(51) Int. Cl.
*B26D 1/56* (2006.01)
*B65H 35/04* (2006.01)

(52) U.S. Cl. ..... 83/177; 83/100; 83/438; 83/452; 242/527.2; 242/532

(58) Field of Classification Search ..... 242/56, 242/58.1, 58.2, 58.3, 58.4, 533, 526, 532, 242/542, 532.3, 521, 526.1, 524.1, 527, 527.2, 242/272; 162/193, 194, 255, 359, 286, 358, 162/360.1; 257/686, 668, 684, 783; 83/177, 83/835, 74, 76, 206, 776, 277, 23, 27, 100, 83/152, 452, 453, 209, 210, 211, 221, 98, 83/438, 117

See application file for complete search history.

(56) References Cited

U.S. PATENT DOCUMENTS 3,817,467 A * 6/1974 Dambroth ..... 242/527.2
3,918,654 A * 11/1975 Okubo et al. ..... 242/527.2
4,097,323 A * 6/1978 De Roeck et al. ..... 156/159
4,408,727 A * 10/1983 Dropczynski ..... 242/521
4,422,586 A * 12/1983 Tetro ..... 242/527.3
4,422,588 A * 12/1983 Nowisch ..... 242/524.1
4,472,850 A * 9/1984 Beucus et al. ..... 8/149.1
4,493,684 A * 1/1985 Bolton ..... 493/234
4,529,141 A * 7/1985 McClenathan ..... 242/527.1
4,552,316 A * 11/1985 Dropczynski et al. ..... 242/521
5,022,597 A * 6/1991 Morizzo ..... 242/413.5

(Continued)

FOREIGN PATENT DOCUMENTS

DE 199 62 731 A 6/2001

(Continued)

OTHER PUBLICATIONS

Partial International Search Report from corresponding PCT application No. PCT/US02/34958, dated Mar. 13, 2003, 2 pages.

(Continued)

*Primary Examiner*—Ghassem Alie
(74) *Attorney, Agent, or Firm*—Brinks Hofer Gilson & Lione

(57) ABSTRACT

An apparatus and method for cutting and threading a sheet of material is described. The apparatus can facilitate the transfer of a sheet from a sheet forming machine to a processing machine, and can halt the feeding of sheet material to the processing machine. When the processing machine is ready to receive more sheet material, the apparatus cuts the sheet and feeds the newly formed sheet to the processing machine.

10 Claims, 14 Drawing Sheets

U.S. PATENT DOCUMENTS 5,024,128 A * 6/1991 Campbell, Jr. ..... 83/26
5,037,509 A * 8/1991 Wedel ..... 162/286
5,368,252 A * 11/1994 Biagiotti ..... 242/521
5,383,622 A * 1/1995 Kohler ..... 242/527.2
5,588,644 A * 12/1996 Lotto et al. ..... 271/183
5,620,544 A * 4/1997 Cram et al. ..... 156/184
5,769,352 A * 6/1998 Biagiotti ..... 242/521
5,875,989 A * 3/1999 Alexander, III ..... 242/533
5,960,296 A * 9/1999 Auzino et al. ..... 438/401
6,082,659 A * 7/2000 Sankaran et al. ..... 242/527.2
6,085,490 A * 7/2000 Buchko ..... 53/411
6,435,449 B1 * 8/2002 Wohld et al. ..... 242/523.1

FOREIGN PATENT DOCUMENTS

DE 199 63 285 A 6/2001
WO WO 99/27184 * 3/1999
WO WO 99/27184 6/1999

OTHER PUBLICATIONS

International Search Report from corresponding PCT application No. PCT/US02/34958, dated Jul. 2, 2003, 11 pages.

* cited by examiner

AUTO SHEET THREADING AND CUTTING DEVICE AND METHOD

BACKGROUND

In manufacturing products from sheet material, it is necessary to process the sheet after it is formed. Sheet materials include, for example, paper webs, webs of synthetic fibers and nonwoven webs, as well as polymer sheets such as plastics and elastomers. For webs made of fibrous material, the web must be transferred from the machine used to form the web to a machine which will process the web into a more useful product. The processing machine is frequently a winding reel, but may also be, for example, an apparatus for segmenting the web into portions, for treating the web with additives, for folding or stitching the web, or for bonding the web to another substance.

While the sheet formation is usually a continuous process, the processing of the sheet may or may not be continuous. The processing may be a batch process having a distinct beginning and ending. The processing may be designed as a continuous process, but may be subject to more frequent interruptions than the sheet formation. In the case of winding webs of fibrous material, an initial edge of the web may be attached to a core or mandrel, after which the web can be wound around this initial edge. Once the winding has produced a roll of the desired size, the roll must be separated from the web issuing from the sheet former. A new initial edge from the sheet can then be used to begin a new roll once the edge is threaded to the winder.

The separation of the web can be performed manually by a user impacting the sheet as it passes between the forming machine and the processing machine. The initial edge formed can be fed to another processor, or another initial edge may be formed by impacting or slicing the sheet again. Manual breaking and threading is especially difficult for fibrous webs which are heavy and strong and which have large widths, nor are they useful at high sustained operating speeds.

For sheets of fibrous web material, conventional threading procedures involve the adjustment of the size of the web as it is formed. A more narrow portion of the sheet is formed to function as a leader. This leader is easier to handle than a full-width sheet and can be threaded to the processing machine. The width of the sheet is then expanded to full size by adjusting the formation process. This adds undesirable complexity to the process, as both the processing machine and the forming machine must be adjusted, increasing the likelihood of operator error and machine malfunction.

It is thus desirable to provide an apparatus that will separate a formed sheet from a processed sheet, create a new edge from the formed sheet, and feed the new edge to a processing apparatus. It would be especially useful if this apparatus could function automatically, with minimal involvement by the operator, and if the apparatus could dispense any waste material into a desired area.

BRIEF SUMMARY

In an embodiment of the invention, there is provided an apparatus for cutting and threading a sheet material, comprising a feed roll; a scrap roll; a first shoe, capable of contacting a sheet of material to the scrap roll; a second shoe, capable of contacting a sheet of material to the feed roll; and a knife; wherein the knife impacts and cuts the sheet when the sheet is in contact with the scrap roll and the first shoe, and when the sheet is in contact with the feed roll and the second shoe.

These embodiments may further comprise an apparatus wherein the feed roll directs the sheet towards a processing apparatus; the feed roll is a vacuum roll; the scrap roll diverts the sheet away from a processing apparatus; the scrap roll is a vacuum roll; the sheet is a fibrous web; and wherein the feed roll, scrap roll, first shoe, second shoe and knife are automatically controlled such that the sheet transfers between being directed toward the processing apparatus and being diverted away from the processing apparatus in a continuous manner.

In another embodiment of the invention, there is provided an apparatus for cutting and threading a sheet material, comprising a frame; an anvil roll; and a knife roll; the anvil roll and knife roll movably mounted to the frame to provide an arcuate motion to the rolls at least between a first position and a second position. A sheet of material is directed to a processing apparatus by passing between the anvil roll and the knife roll in the first position; the sheet of material is directed away from the processing apparatus by passing between the anvil roll and the knife roll in the second position; and the sheet of material is cut by the convergence of the knife roll and anvil roll.

These embodiments may further comprise an apparatus wherein the convergence of the rolls in the second position separates the sheet into sections; the convergence of the rolls in the second position further directs the sheet to a scrap location; the knife roll and anvil roll are automatically controlled such that the sheet transfers between being directed toward the processing apparatus and being diverted away from the processing apparatus in a continuous manner; the sheet is a fibrous web; and an apparatus further comprising an idler roll positioned to contact the sheet before it is directed to the processing apparatus.

In another embodiment of the invention there is provided an apparatus for cutting and threading a sheet material, comprising: a transfer blade having a retracted position and an extended position; and a pair of nip rolls. A sheet of material passing between the retracted position and the extended position is diverted away from a processing apparatus by passing between the nip rolls; and the movement of the transfer blade from the retracted position to the extended position directs the sheet toward the processing apparatus.

These embodiments may further comprise an apparatus wherein the sheet is broken by the movement of the transfer blade from the retracted position to the extended position; wherein the sheet is in contact with the nip rolls; the sheet moves at a first speed and is broken by a stress applied to the sheet by the rotation of the nip rolls at a second speed greater than the first speed; the sheet moves at a first speed and is broken by a stress applied to the sheet by the combination of the movement of the transfer blade from the retracted position to the extended position and the rotation of the nip rolls at a second speed greater than the first speed; the transfer blade comprises air jets; the sheet is a fibrous web; wherein the transfer blade and nip rolls are automatically controlled such that the sheet transfers between being directed toward the processing apparatus and being diverted away from the processing apparatus in a continuous manner; and an apparatus further comprising an idler nip roll, wherein the idler nip roll provides tension to the sheet when the sheet is in contact with the nip rolls or the transfer blade.

In another embodiment of the invention, there is provided an apparatus for cutting and threading a sheet material, comprising means for directing a sheet toward a processing apparatus; means for cutting the sheet; means for directing the sheet away from the processing apparatus; and means for simultaneously cutting the sheet and directing the sheet toward the processing apparatus.

These embodiments may further comprise an apparatus further comprising means for cutting the sheet into sections when the sheet is directed away from the processing apparatus; and wherein the sheet is a fibrous web.

In another embodiment of the invention, there is provided a method for handling a sheet of material, comprising providing a formed sheet of material; breaking the sheet of material to form an initial edge to the formed sheet and a scrap portion; directing the initial edge to a processing machine; and diverting the scrap portion away from the processing machine; wherein the breaking, directing, and diverting are automatically controlled such that the providing is a continuous process.

These embodiments may further comprise a method wherein the breaking, directing, and diverting are simultaneous; the breaking comprises impacting the sheet with a knife; the breaking comprises contacting the sheet between an anvil roll and a knife roll; the sheet moves at a first speed, and the breaking comprises applying a stress applied to the sheet by contacting the sheet between two nip rolls rotating at a second speed greater than the first speed; the directing comprises contacting the sheet with a feed roll; the sheet moves along a path away from the processing apparatus, and the directing comprises moving a transfer blade from a retracted position to an extended position through the path of the sheet; the diverting comprises contacting the sheet with a scrap roll; and the diverting comprises passing the sheet between a pair of nip rolls.

DETAILED DESCRIPTION

An apparatus for handling a sheet of material is provided which in general provides for separating a formed sheet from a processed sheet, creating a initial edge from the formed sheet, and feeding this edge to a processing machine. The apparatus can be operated in an automatic fashion such that, when the processing machine can no longer accept more sheet material, the formed sheet is separated and directed away from the processing machine. The automatically operated apparatus further separates the formed sheet from the portion of the sheet that was directed away from the processing machine and then feeds the formed sheet to the processing machine. The apparatus of the present invention is referred to herein as a "handling apparatus."

Figure 1:
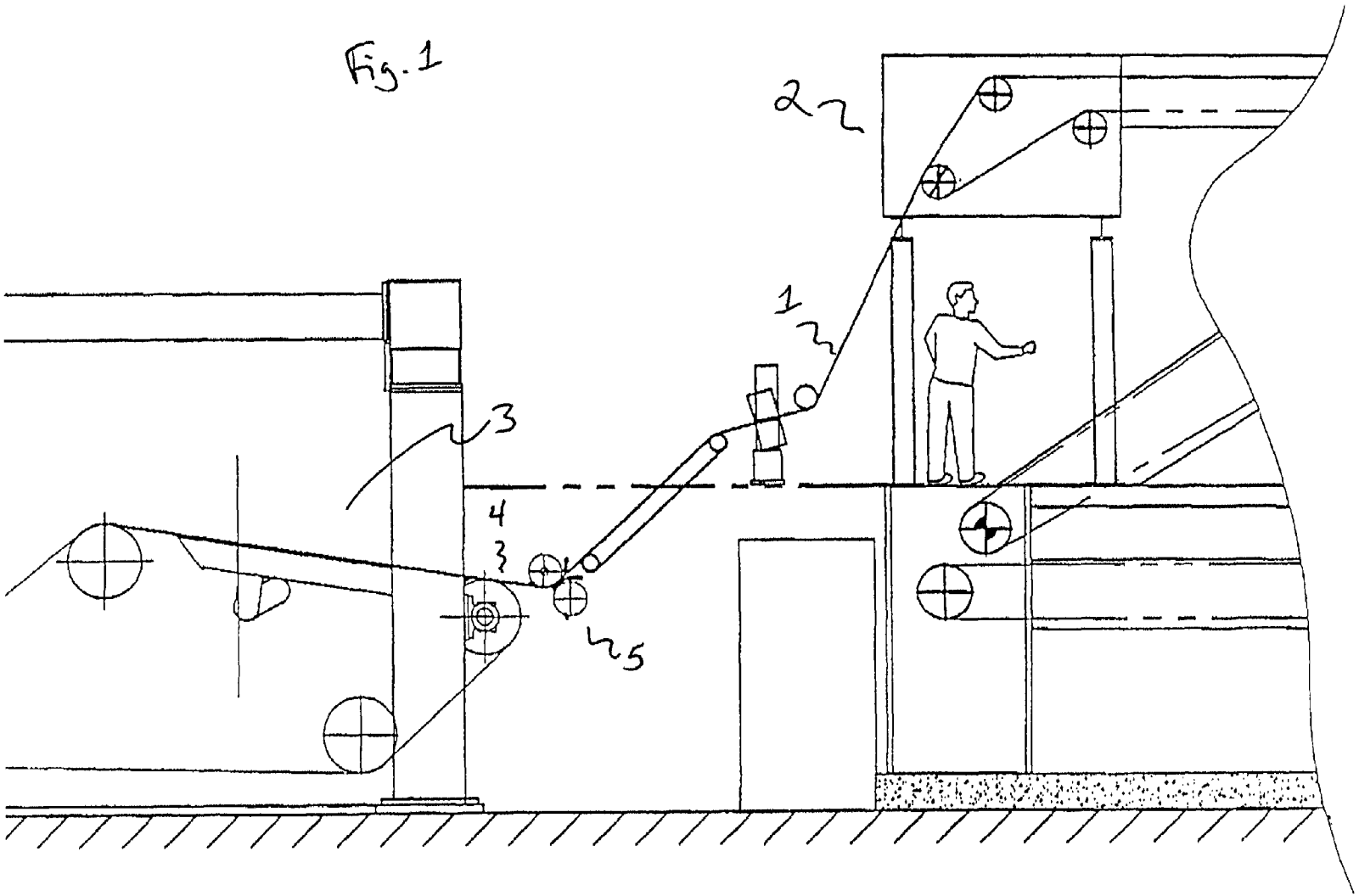
FIG. 1 is a diagrammatic view of a sheet forming machine, a processing apparatus, and a handling apparatus.

Referring to FIG. 1, there is in general provided a sheet of material 1, issuing from a forming machine 2. This formed sheet may be any type of sheet material known to those skilled in the art. For example, the sheet may be a polymer sheet formed from an extruder. The sheet may be a fibrous web. For example, the web may be a non-woven basesheet, such as a dry-formed basesheet or a wet-laid basesheet, including tissue and towel basesheets. The web may be an airlaid, spunlaid, hydroentangled, spunbond, or melt-blown basesheet. The web may be a multi-layer basesheet, such as a laminate of any combination of these basesheets. The basesheet may contain a binder, for example a non-dispersible binder, such as a latex binder or a cross-linkable binder; or a water-dispersible binder, such as a temperature-sensitive water dispersible binder or an ion-sensitive water dispersible binder, such as those disclosed in co-pending patent applications, Ser Nos. 09/564,449; 09/564,213; 09/565,125; 09/564,837; 09/564,939; 09/564,531; 09/564,268; 09/564,424; 09/564,780; 09/564,212; 09/565,623 all filed May 4, 2000; application Ser. No. 09/223,999, filed Dec. 31, 1998; and application Ser. No. 09/900,698, filed Jul. 6, 2001, the disclosures of which are incorporated herein by reference.

Examples of individual webs include a melt-blown basesheet with a latex binder; a spun-bond basesheet with a temperature-sensitive water dispersible binder; and an airlaid basesheet with an ion-sensitive water dispersible binder. The web may be a single sheet, or the web may have multiple sheets which are combined to form a multi-ply sheet. Multi-ply sheets may be bonded together, for example with adhesives, thermal bonding, sonic bonding, or hydroentanglement.

Referring still to FIG. 1, the sheet is directed to a processing apparatus 3. The processing apparatus may be any processing apparatus known to those skilled in the art. The processing apparatus may be, for example, a roll winder, a slitting machine, an embosser, a heat or chemical treater, a folder, a laminator, or a stitching machine. The apparatus generally has an intake area 4, through which the sheet travels in order to be processed. Handling apparatus 5 is positioned between the forming machine 2 and the processing apparatus 3.

Figure 2:
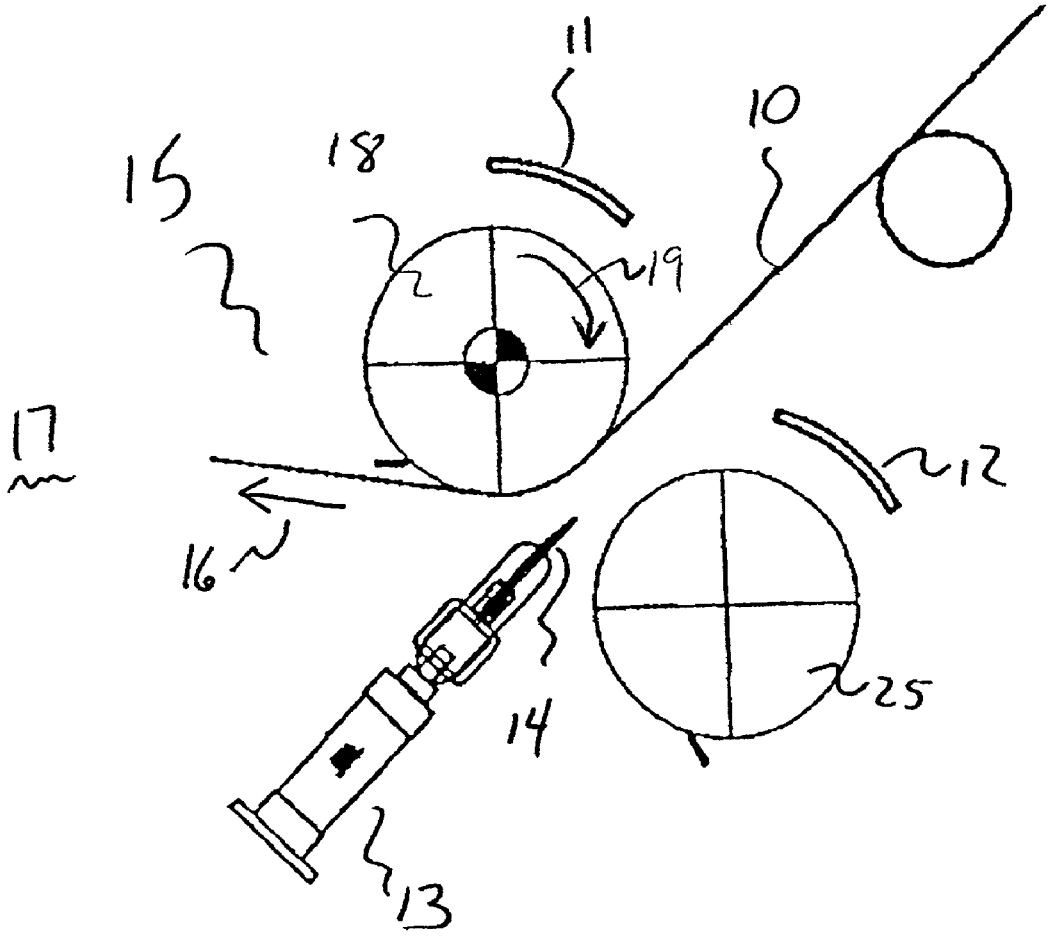
FIG. 2 is a diagrammatic view of a handling apparatus allowing sheet material to travel to a processing apparatus.
Figure 3:
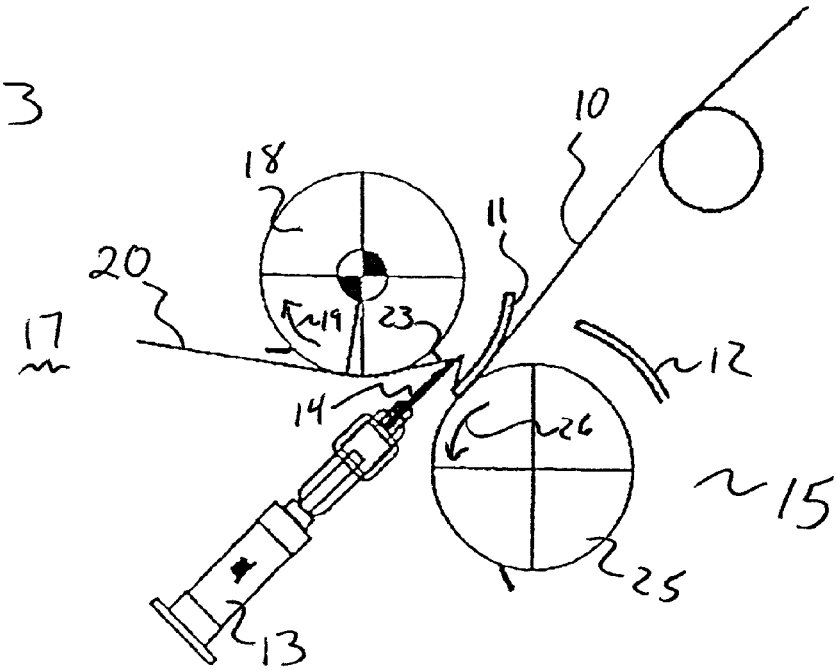
FIG. 3 is a diagrammatic view of a handling apparatus cutting a sheet material.
Figure 4:
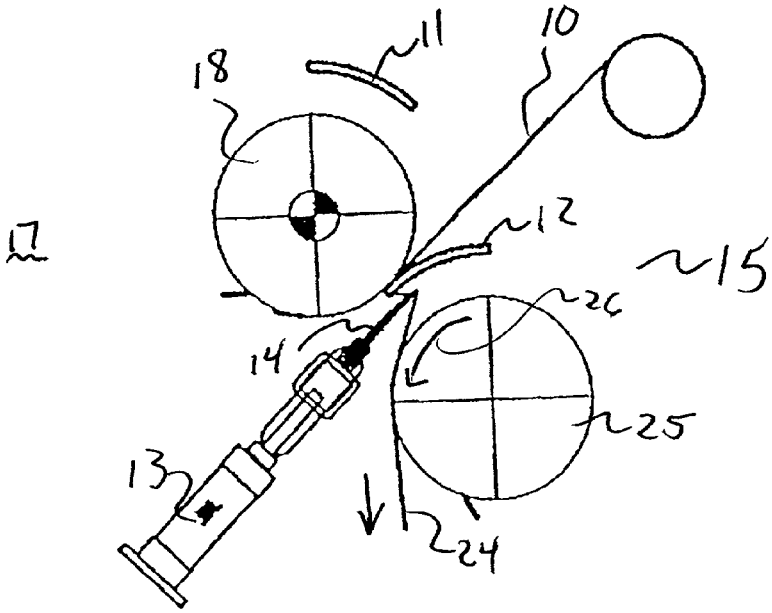
FIG. 4 is a diagrammatic view of a handling apparatus cutting and threading a sheet material.
Figure 5:
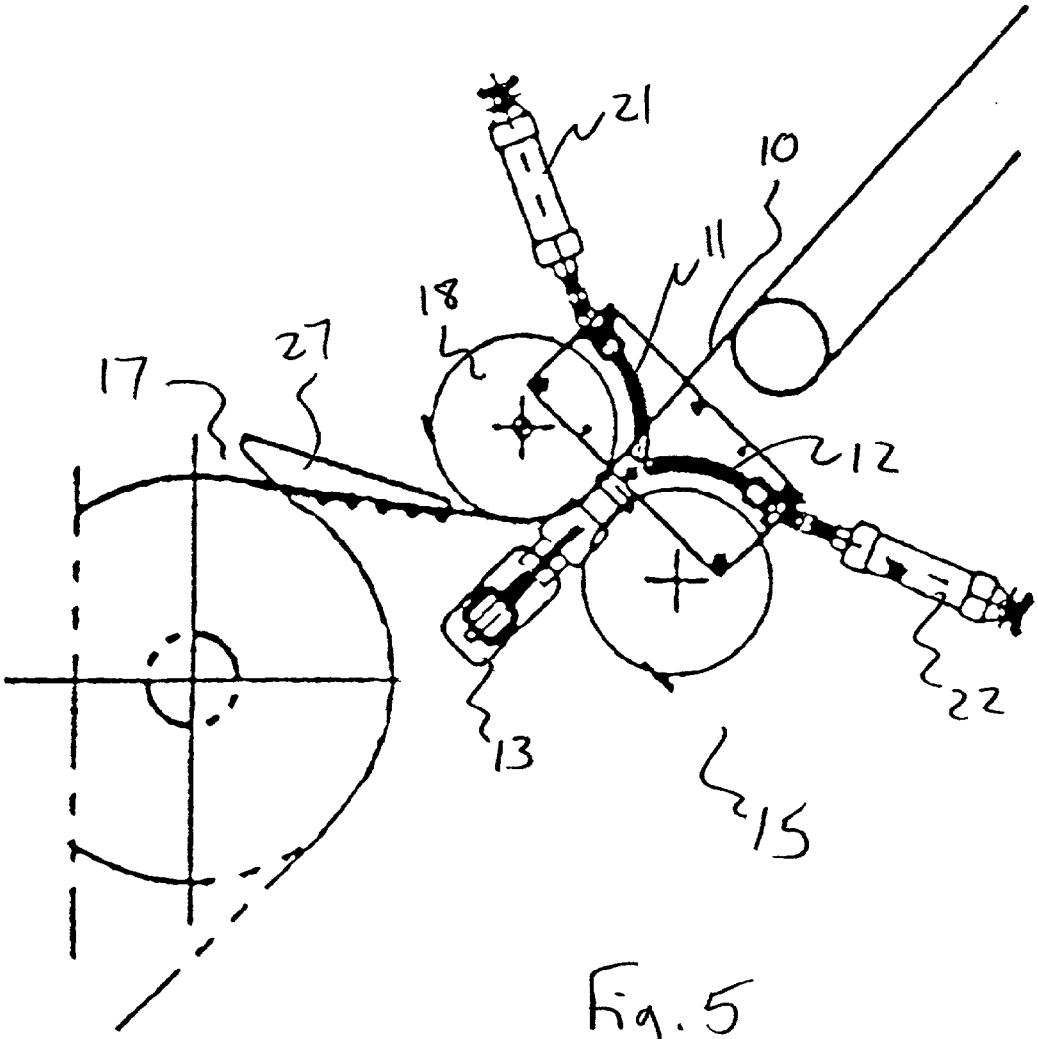
FIG. 5 is another diagrammatic view of the handling apparatus of FIGS. 2-4.

In one aspect, a handling apparatus 5 includes at least one roll for directing the sheet to a processing apparatus, movable shoes for changing the direction of the sheet, and an activated knife (FIGS. 2-5). Referring to FIG. 2, there are two shoes 11 and 12 which function to direct the path of the formed sheet 10. The shoes can be independently extended toward the sheet or retracted away from the sheet, by the action of their respective actuators 21 and 22 (FIG. 5). The actuators may be, for example, servo motors, pistons or cams. The activated knife 13 has a blade 14 which can be extended toward the sheet, in cooperation with the extension of a shoe. FIG. 2 illustrates the handling apparatus 15 in an inactive mode. The shoes and the knife blade are all in a retracted position, and the sheet, traveling in the direction of arrow 16, is being directed to the processing apparatus. In this case, the sheet is directed to the intake area 17 of the processing apparatus by the action of feed roll 18, which rotates in the direction of arrow 19.

FIG. 3 illustrates the handling apparatus 15 in an active mode, separating the formed sheet 10 from the portion of the sheet 20 being directed to the processing apparatus. The upper shoe 11 is extended against scrap roll 25. The knife blade 14 extends against the sheet to cut it. The sheet which is pinned to scrap roll 25 is directed away from the intake area 17, for example to a scrap area. The tail 23 of the sheet being directed to the processing apparatus thus continues to travel into the processing apparatus. The formed sheet is prevented from contacting the feed roll 18 and is instead diverted away from the intake area of the processing apparatus. The motion of the diverted sheet 24 (FIG. 4) is directed by contact with the scrap roll 25, which rotates in the direction of arrow 26.

The diverted sheet may be fed to a different processing apparatus or may be directed to a scrap receptacle. The upper shoe 11 and the knife blade 14 may be maintained in their extended positions, or they may be retracted, as long as the diverted sheet is prohibited from entering the intake area. The knife blade may periodically be extended in order to cut the sheet without changing the overall direction of the sheet. In this way, the diverted sheet is cut into smaller sections, which may be easier to recycle or dispose of.

FIG. 4 illustrates the handling apparatus 15 in another active mode, creating a new initial edge of the formed sheet 10 by separating the formed sheet from the diverted sheet 24. The upper shoe 11 is in a retracted position. The lower shoe 12 is extended against feed roll 18. The knife blade 14 again extends against the sheet, and this contact causes the sheet to break along the line where the sheet and blade meet. This break forms a new initial edge to the formed sheet. The new initial edge and the formed sheet are directed towards the intake area 17 by contact with feed roll 18.

The modes of the handling apparatus 15 may be automatically controlled and coordinated by methods known to those skilled in the art. Preferably, the modes are affected by the status of the processing apparatus. That is, when the processing apparatus approaches its desired capacity for sheet material, the handling apparatus is activated to cut the sheet and divert it away. Also, when the processing apparatus (or another processing apparatus) is prepared to receive more sheet material, the handling apparatus is activated to cut the diverted sheet and to feed the formed sheet to the intake area.

The rolls 18 and 25 may be equipped with vacuum systems. In this way, the contact between the roll and the sheet is enhanced, ensuring that the sheet travels in the proper direction. The contact between the sheet and a roll may be broken by gravity or by contact with a diverter, such as an airfoil 27 (FIG. 5). Other directing tools such as belts and airfoils may be used in place of or in addition to the rolls. The knife blade may be used with a backing anvil. The shoes and knife blade preferably extend the entire width (or, cross-direction) of the sheet.

Figure 6:
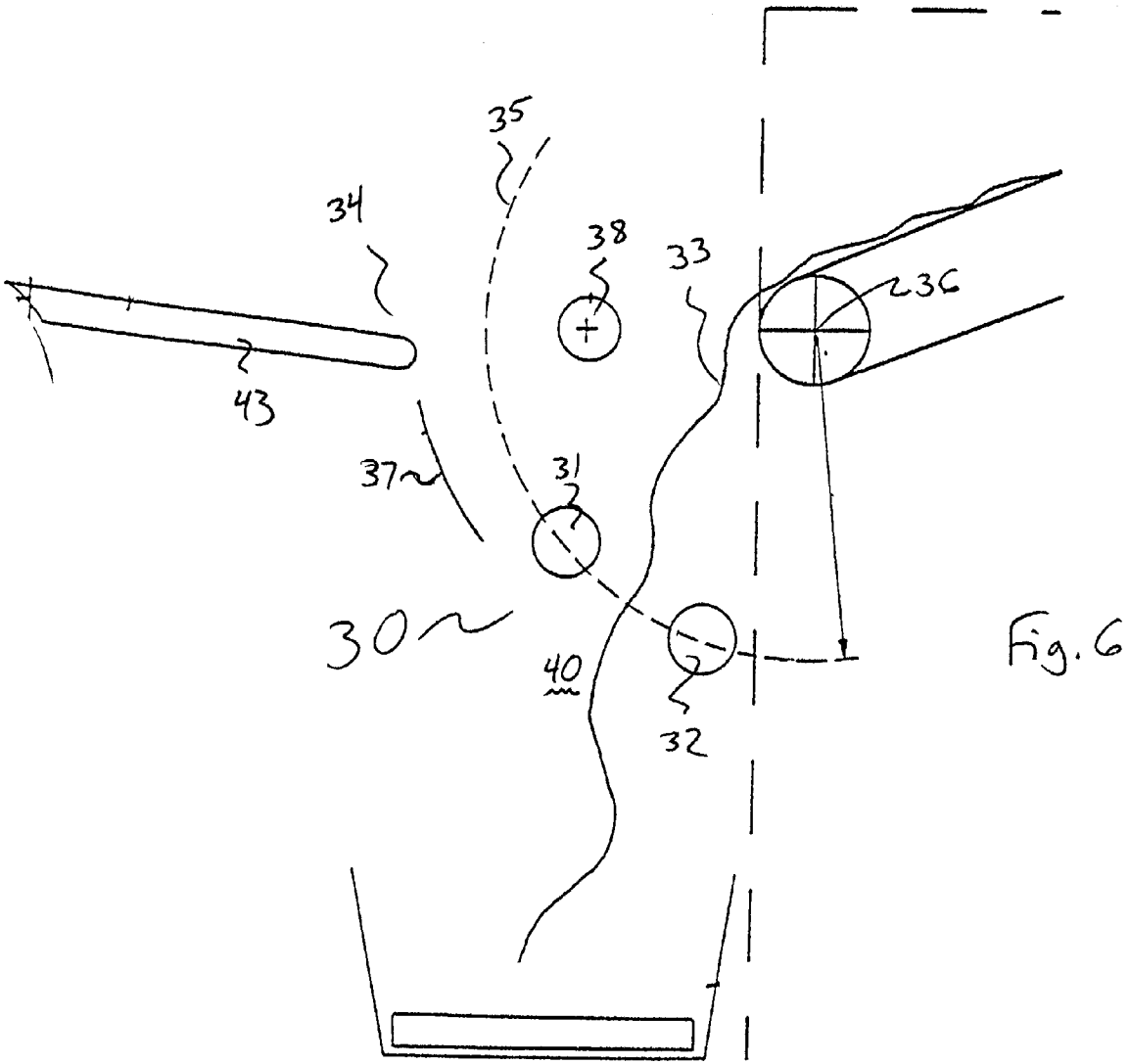
FIG. 6 is a diagrammatic view of a handling apparatus having an anvil roll and a knife roll in the "down" position.

In another aspect, a handling apparatus 30 includes an anvil roll, a knife roll, and optionally an idler roll (FIGS. 6-10). Referring to FIG. 6, the knife roll 31 and anvil roll 32 are in the "down" position 40. The formed sheet 33 is deposited away from the intake area 34 of the processing apparatus. The knife roll and anvil roll may be stationary, or they may be capable of rotation on their respective axes. The knife roll and anvil roll are further mounted to move along arc 35. The rolls may be mounted and actuated (whether rotational motion or motion along the arc) by methods known to those skilled in the art. For example, the rolls may be mounted on simple swing arms which move in an arcuate path centered on axis 36. The rolls may be mounted on a 4-bar linkage. The handling apparatus may further be equipped with a guard 37 to shield the operator from the rolls and other moving parts.

Figure 7:
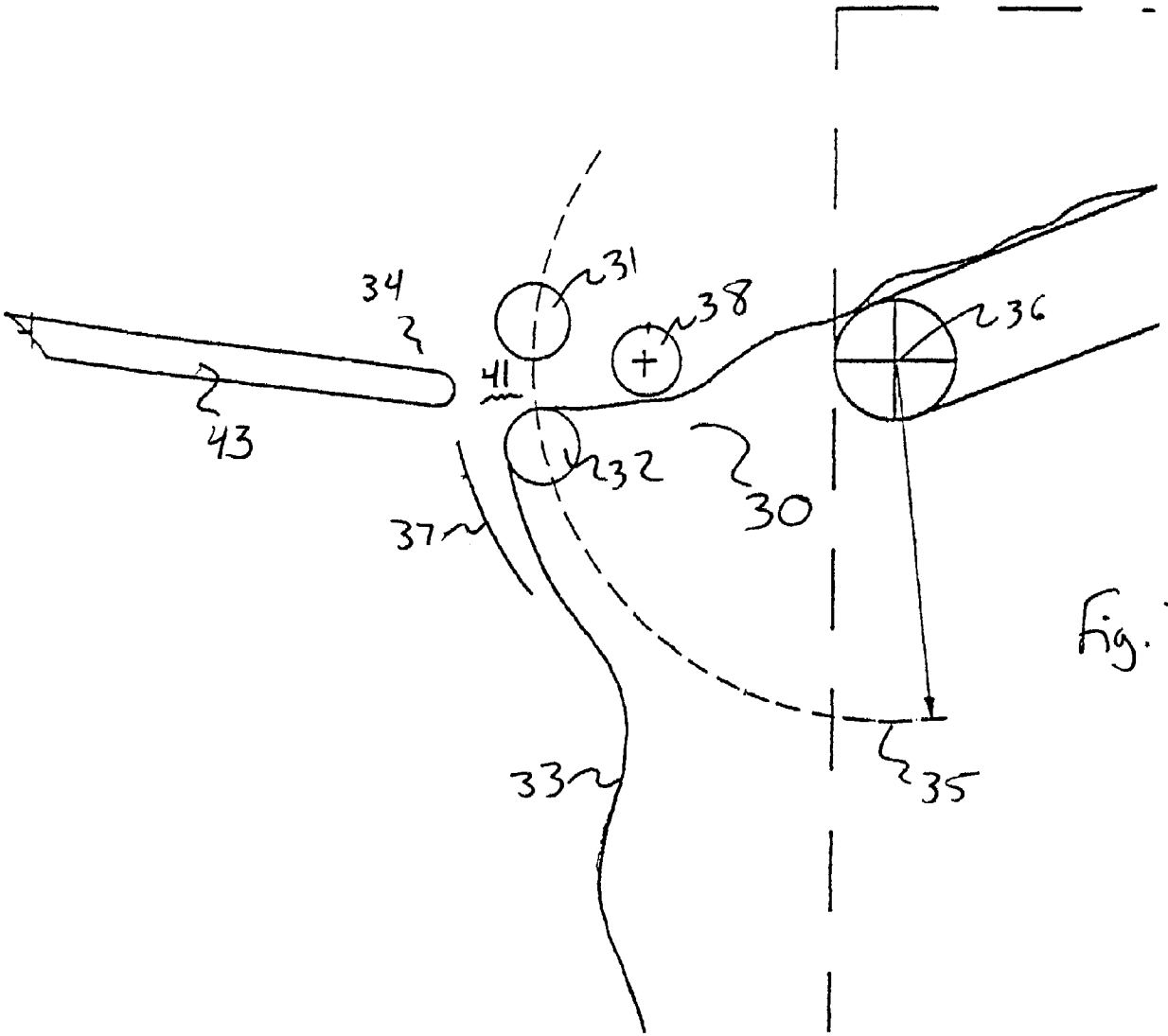
FIG. 7 is a diagrammatic view of the handling apparatus of FIG. 6, with the rolls in the "up" position.

Referring to FIG. 7, the knife roll and anvil roll are generally in the "up" position 41. The formed sheet is in contact with the anvil roll, but is still directed away from the processing apparatus. The formed sheet is in contact with, or in close proximity to, the idler roll 38. The spacing between the knife roll and the anvil roll does not necessarily remain constant as the knife and anvil rolls move along the arc. However, the sheet remains positioned between the knife and anvil rolls.

Figure 8:
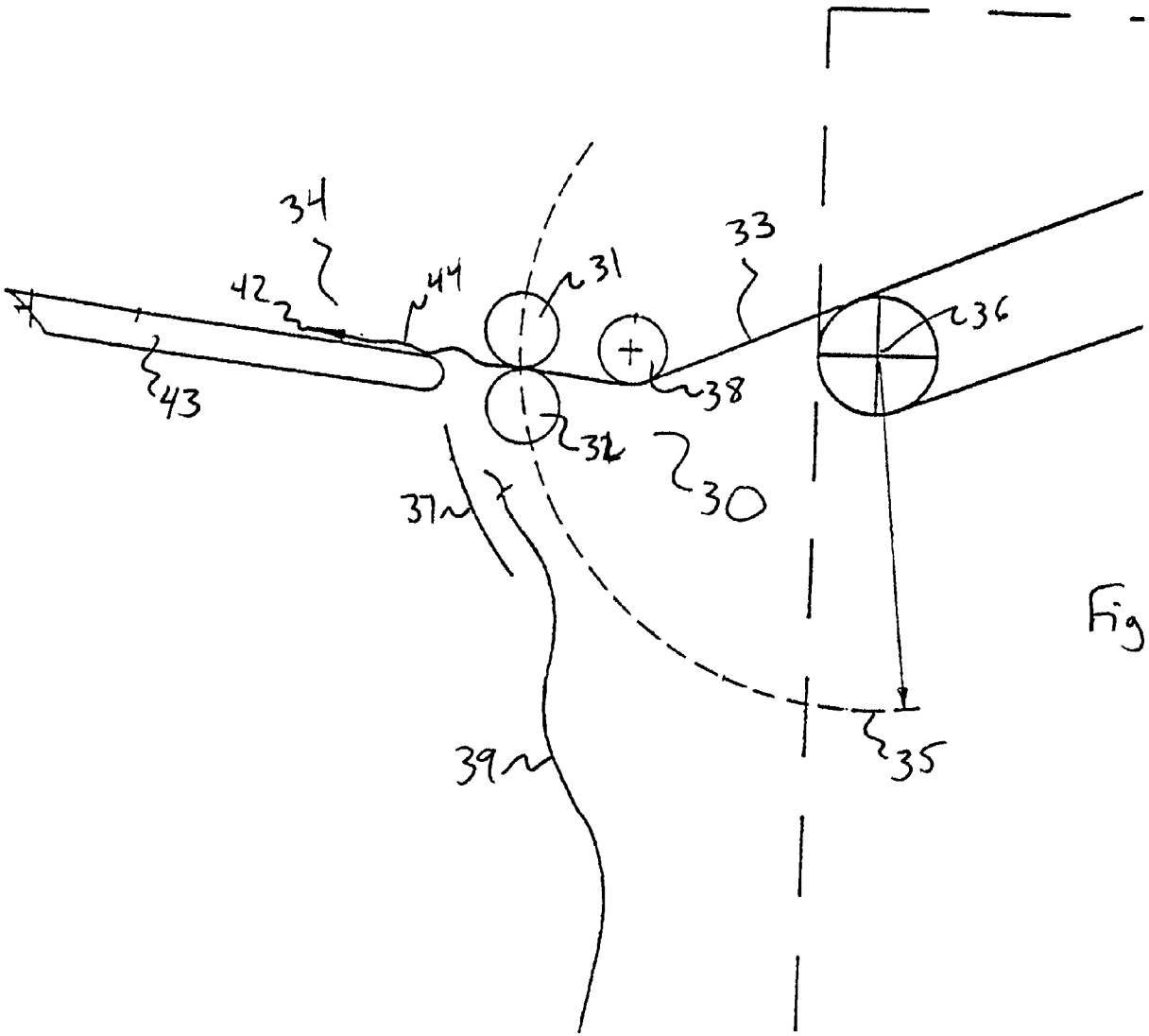
FIG. 8 is a diagrammatic view of the handling apparatus of FIG. 6 cutting and threading the sheet material.
Figure 9:
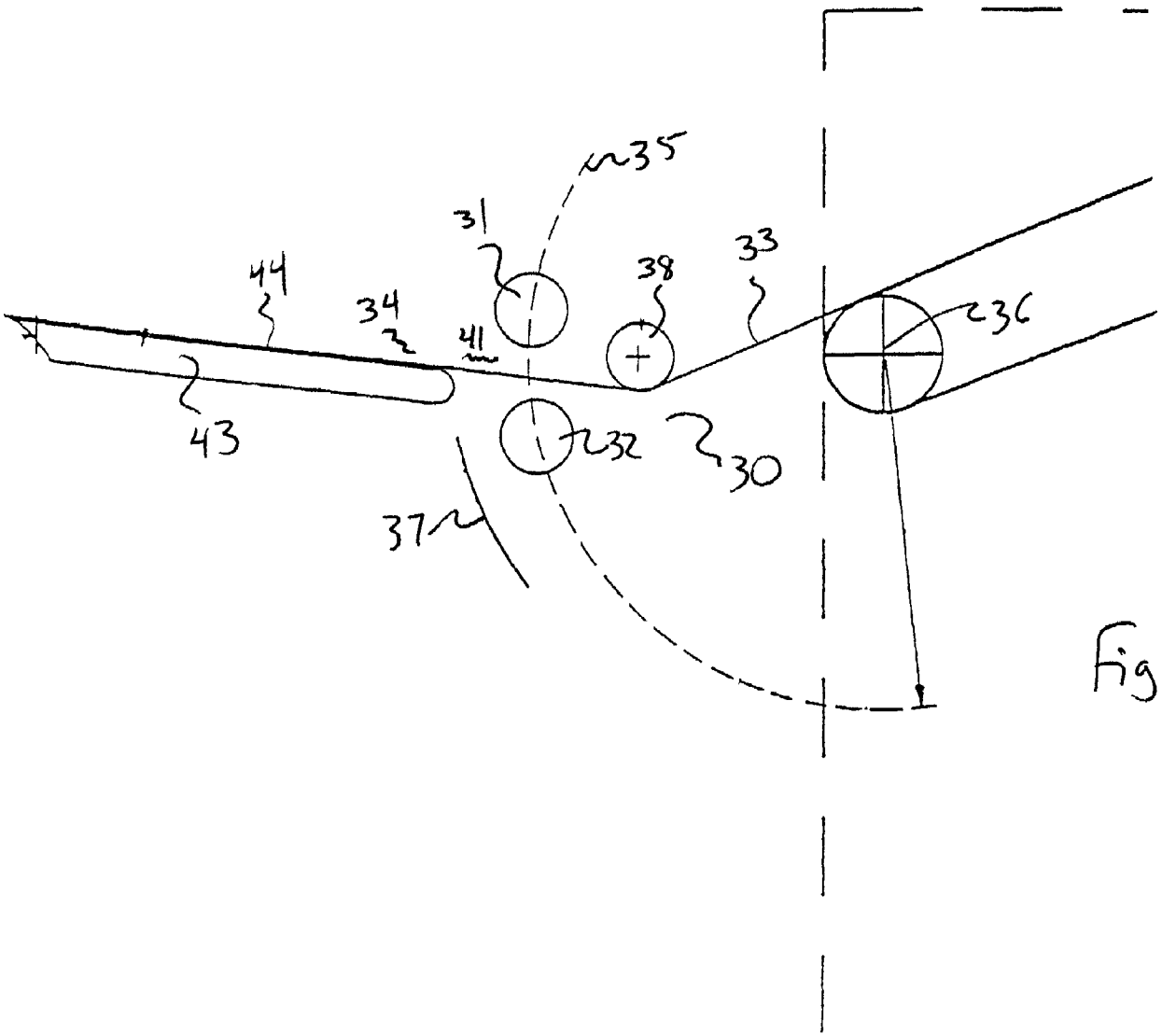
FIG. 9 is a diagrammatic view of the handling apparatus of FIG. 6 allowing sheet material to travel to a processing apparatus.

Referring to FIG. 8, contact between the knife roll 31 and the anvil roll 32 causes a separation between the diverted sheet 39 and the formed sheet 33. The newly created initial edge 42 is thus directed to the intake area 34 of the processing apparatus. The transport of the initial edge may be caused by the momentum of the sheet itself, or it may be supplemented with another force, for example by a blast of air. The intake area may optionally include a guiding tool 43 such as an air foil or a belt. The idler roll 38 helps keep tension on the sheet to assist in the separation. After the separation of the sheet, the idler roll directs the formed sheet to the processing apparatus, as illustrated in FIG. 9.

Figure 10:
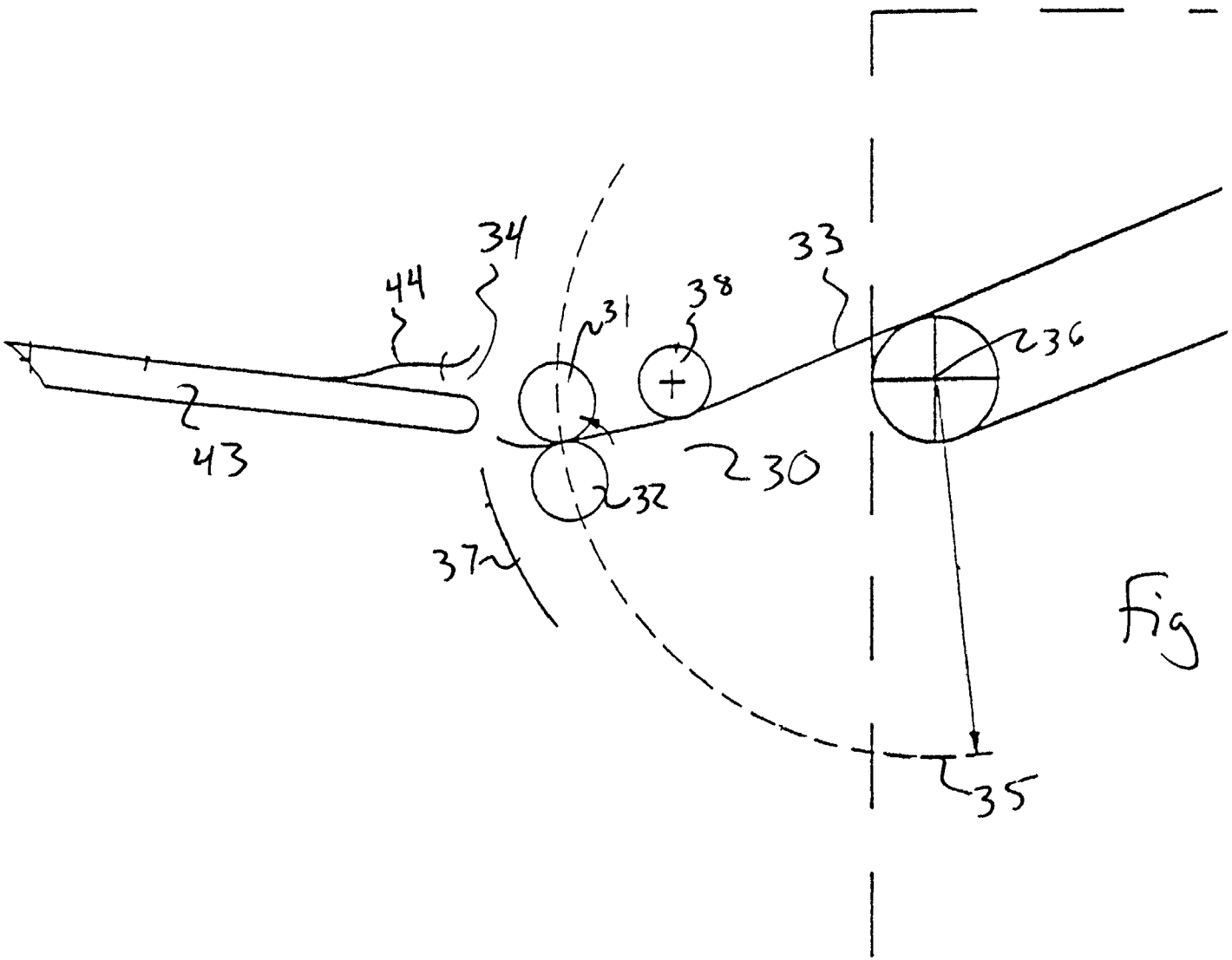
FIG. 10 is a diagrammatic view of the handling apparatus of FIG. 6 cutting the sheet material.

Referring to FIG. 10, the formed sheet 33 is separated from the sheet to be processed 44 by the contact of the knife roll and anvil roll. Although the knife and anvil rolls do not necessarily stay in contact, they both move from the "up" position toward the "down" position to ensure that the formed sheet is kept away from the intake area 34. The knife and anvil rolls may periodically converge while in the "down" position to provide more manageable sections of the unprocessed sheet.

The action of the knife roll 31 and anvil roll 32 may be automatically controlled and coordinated by methods known to those skilled in the art. Preferably, both the position of the rolls (i.e. "up" or "down") and the convergence of the rolls are affected by the status of the processing apparatus. The knife and/or anvil rolls may further be equipped with vacuum systems. Again, other directing tools such as belts and airfoils may be employed in addition to the knife and anvil rolls. The knife, anvil, and idler rolls preferably extend the entire cross-direction of the sheet.

Figure 11:
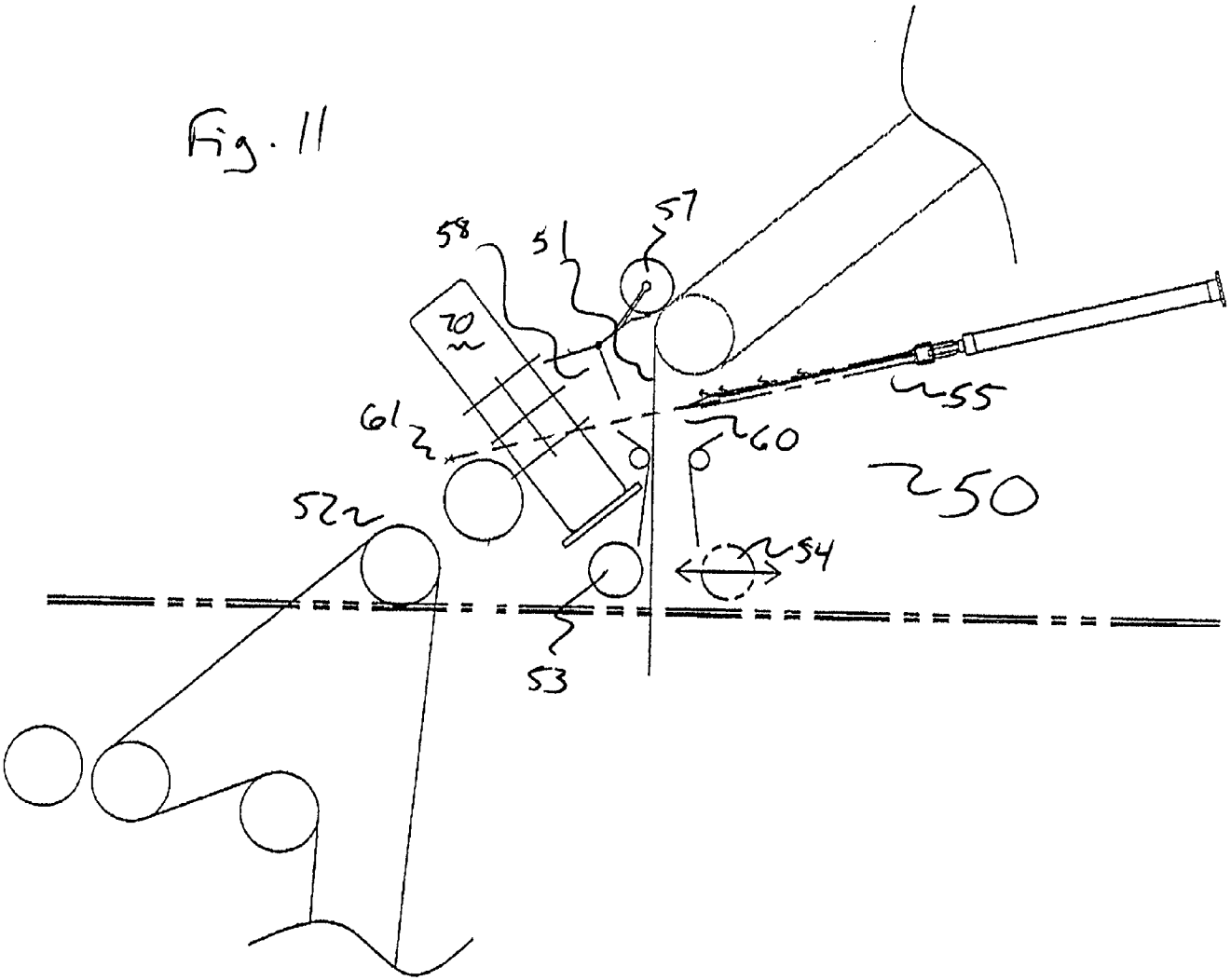
FIG. 11 is a diagrammatic view of a handling apparatus with a transfer blade and nip rolls.
Figure 12:
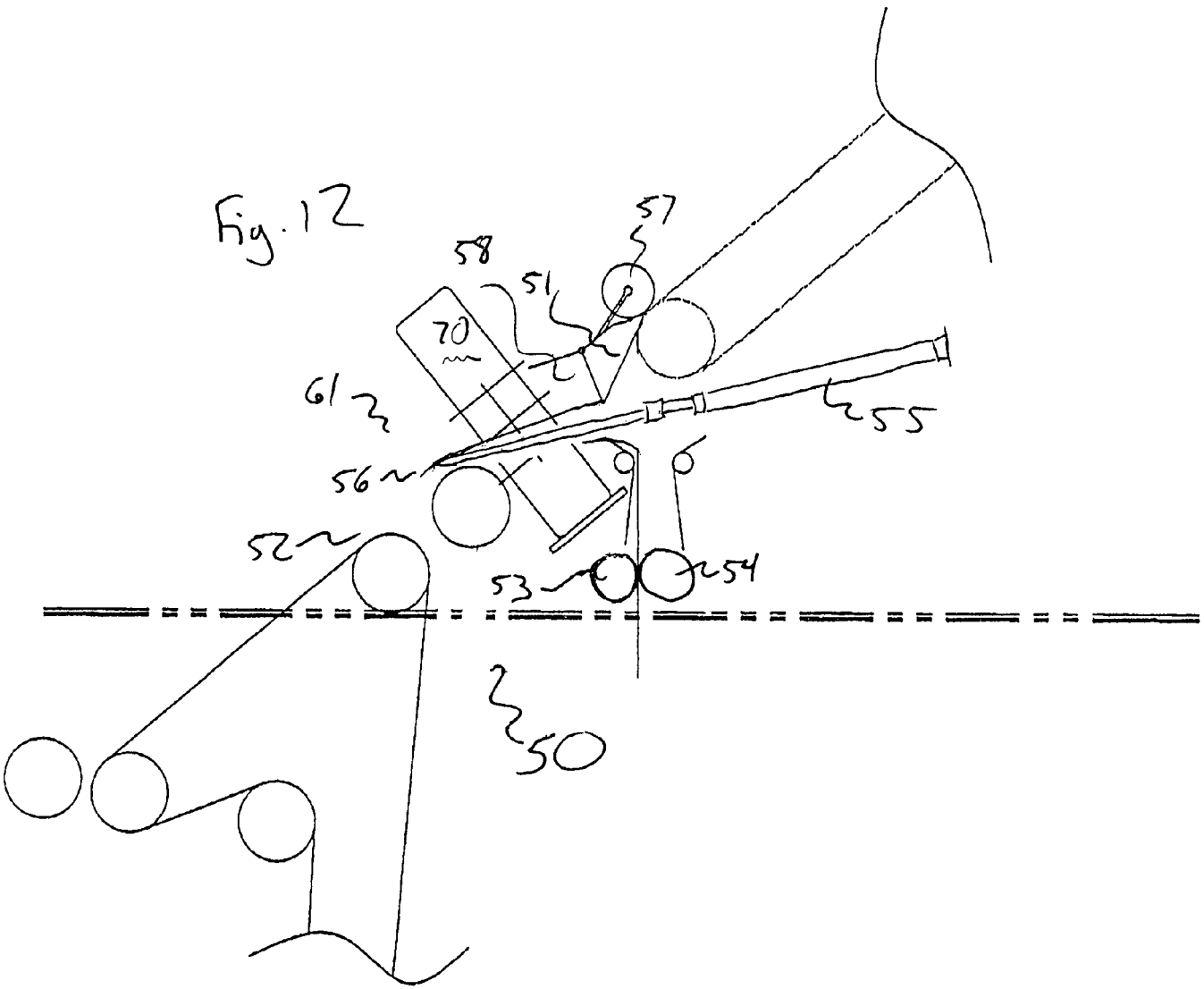
FIG. 12 is a diagrammatic view of the handling apparatus of FIG. 11 cutting and threading the sheet material.
Figure 13:
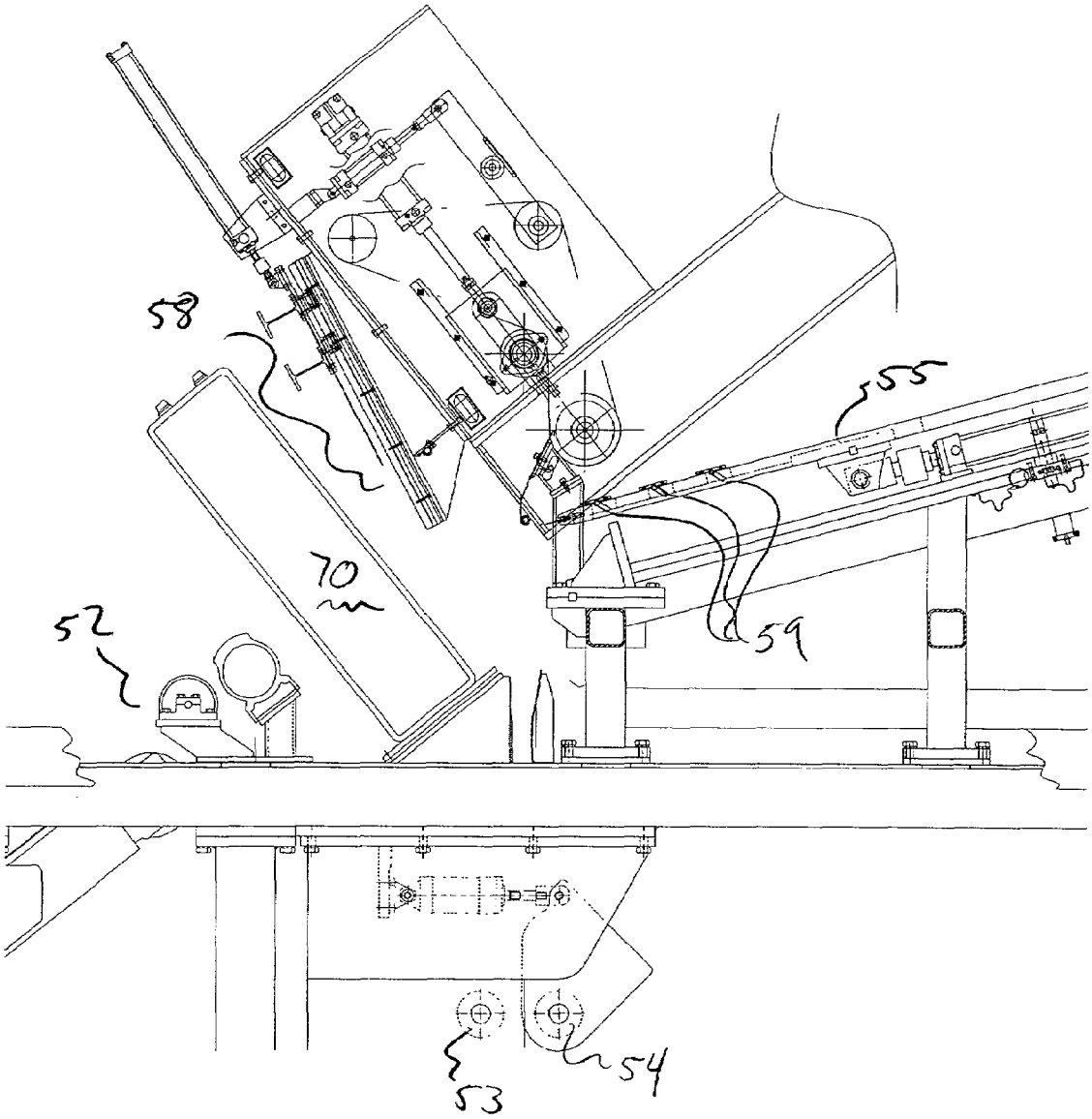
FIG. 13 is a side view of a handling apparatus with a transfer blade and nip rolls.

In another aspect, a handling apparatus 50 includes a transfer blade, a pair of nip rolls, and optionally a deflector and an idler nip roll (FIGS. 11-13). Referring to FIG. 11, the formed sheet 51 is being diverted away from the intake area 52, passing between the nip rolls 53 and 54. The nip rolls rotate about their respective axes and may also move relative to each other. When the nip rolls converge, they pin the sheet between them. If the nip rolls are rotating at a speed greater than the speed of the sheet, they will apply a stress to the sheet. Both of the nip rolls may be capable of moving toward the sheet, or only one of the nip rolls may move to pin the sheet between the rolls.

Figure 14:
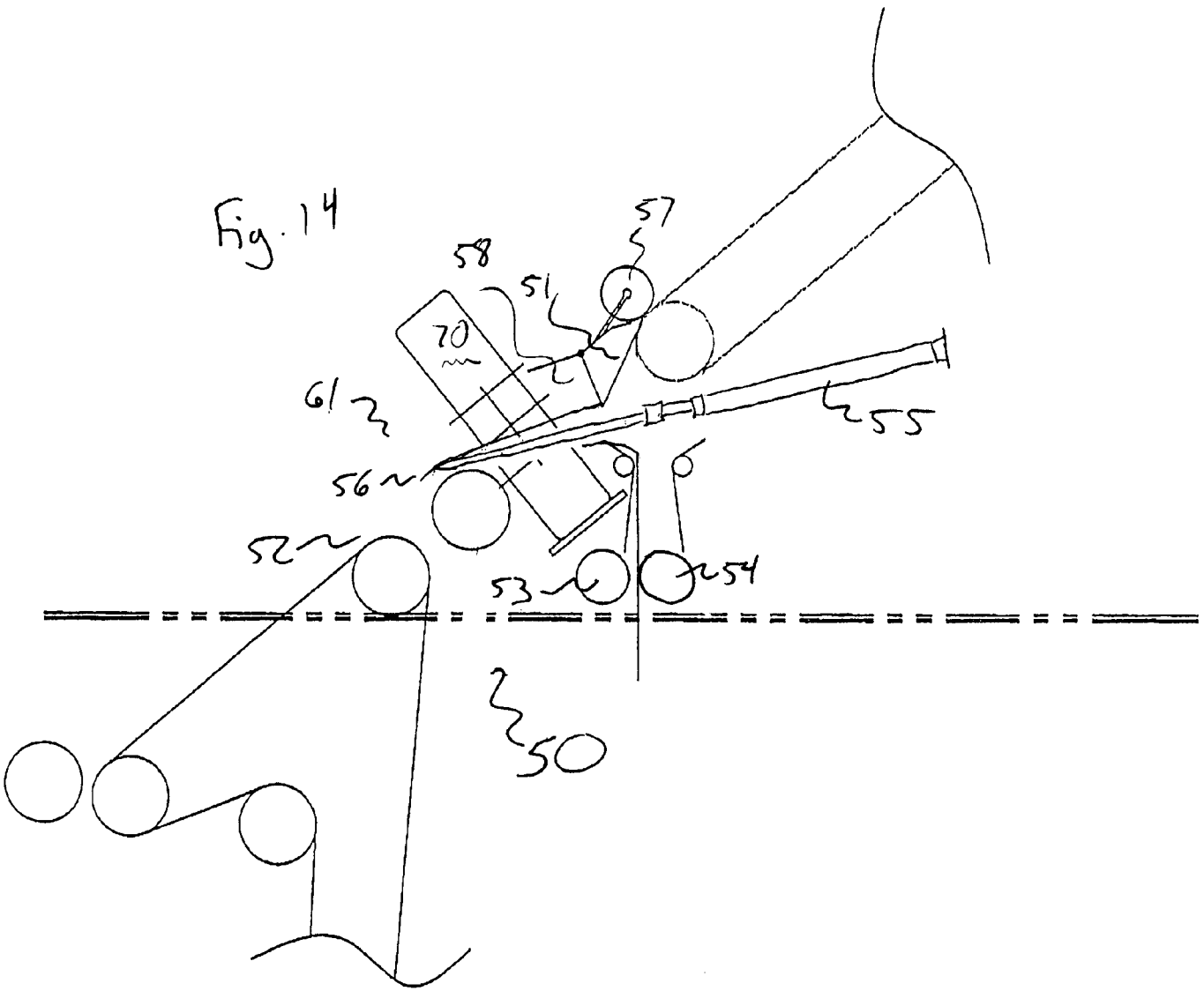
FIG. 14 is a diagrammatic view of the handling apparatus of FIG. 11 breaking and threading the sheet material, where the breaking is performed by the transfer blade.

Referring to FIGS. 11, 12 and 14, the transfer blade 55 can move into the path of the sheet from position 60 to position 61. The impingement of the transfer blade on the sheet breaks the sheet, creating a new initial edge 56 to the formed sheet 51. Referring to FIG. 11, the motion of the transfer blade toward position 61 delivers the new leading edge toward the intake area 52. The transfer blade may have a blunt edge or a razor edge. For example, the transfer blade may contain a plurality of moving blades along its edge, or it may contain air jets 59 to apply a burst of air during the breaking and/or delivery process (FIG. 13).

Figure 15:
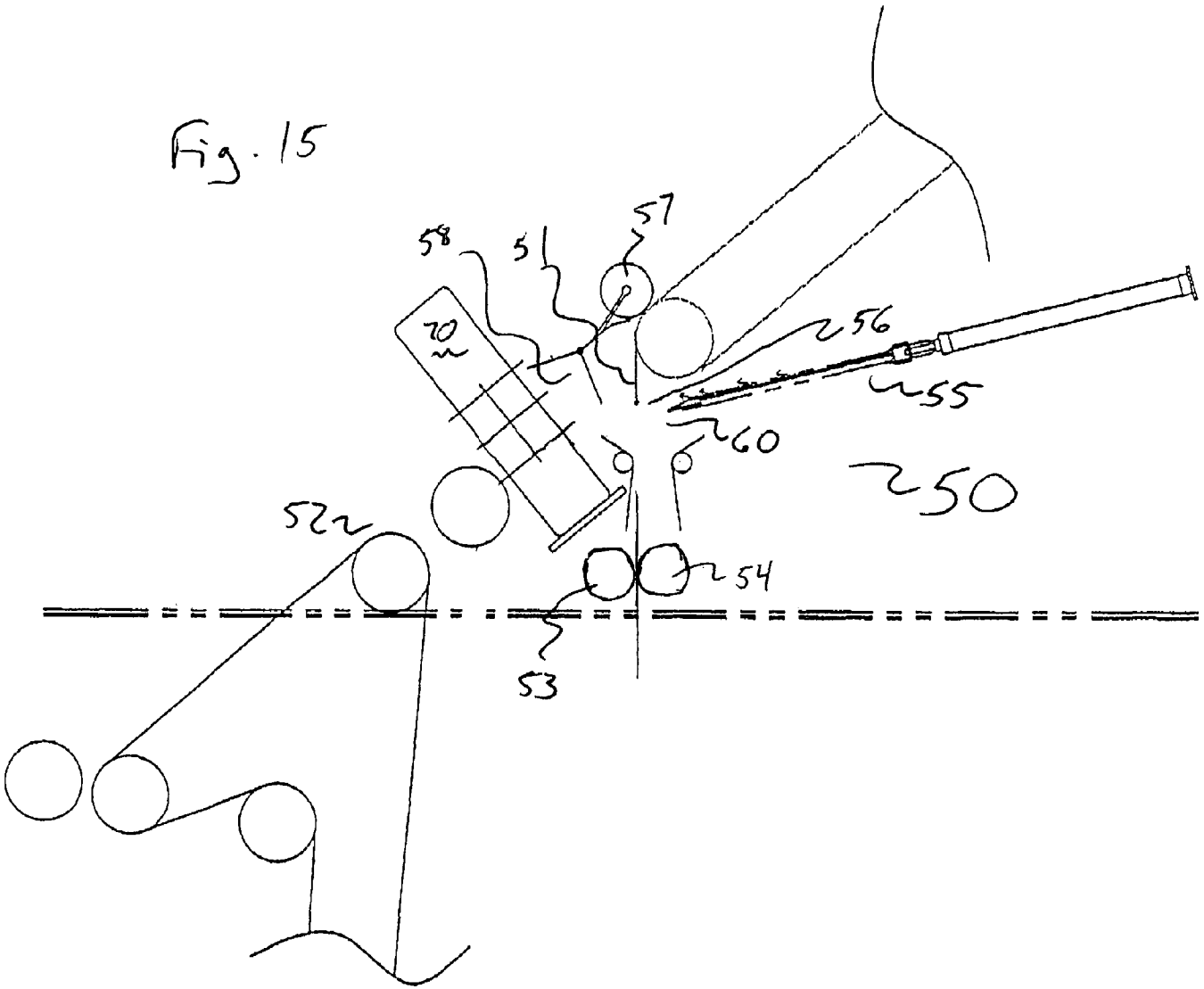
FIG. 15 is a diagrammatic view of the handling apparatus of FIG. 11 breaking and threading the sheet material, where the breaking is performed by the nip rolls.

The breaking of the sheet may be accomplished by the action of the nip rolls (FIG. 15), by the action of the transfer blade (FIG. 14), or by the nip rolls and transfer blade together (FIG. 12). The nip rolls are capable of breaking the sheet by increasing their speed of rotation, when the nip rolls are already in contact with the sheet, or by contacting the sheet at a speed greater than the speed of the web. When the sheet is broken by the nip rollers, the newly formed initial edge 56 is threaded to the processing machine by the transfer blade. The transfer blade contacts the sheet and delivers it to the processing machine, through any machinery or instrumentation, shown generally as 70 in FIGS. 11-15, that is positioned between the forming machine and the processing machine. The transfer blade may also contribute, in part or in whole, to the breaking of the sheet. The impact of the blade, particularly when the sheet is in tension between the nip rolls and the idler nip, separates the sheet, and the newly formed portion is delivered to the processing machine.

The optional idler nip roll 57 and the deflector 58 may further assist in the delivery of the initial edge to the intake area. The deflector can be moved toward or away from the web, depending on operating conditions and the progress of product formation. The deflector contacts the sheet as necessary, preventing the sheet from traveling away from the intake area. The contact of the idler nip 57 on the sheet helps keep sufficient tension on the sheet to enable a reproducible breaking process and threading process. FIG. 12 illustrates the apparatus during the breaking process, with the nip rolls 53 and 54 pinning the sheet, the transfer blade 55 impinging on the sheet, and the idler nip roll 57 and deflector 58 contacting the sheet.

The deflector 58, in optional combination with the transfer blade, breaks the sheet to separate the formed sheet from the sheet to be processed. The contact of the deflector on the sheet causes a stress on the sheet. This stress alone may break the sheet, or the stress can be augmented by the impingement of the transfer blade on the sheet. Once the sheet has been broken, the orientation and position of the deflector directs the sheet away from the intake area 52. The formed sheet thus passes between the nip rolls 53 and 54.

Features of the above aspects may also be combined into other embodiments of the handling apparatus. For example, an actuated knife blade may converge with a backing anvil rather than a shoe. Nip rolls may be positioned to contact the sheet before or after the sheet passes by the knife, shoes, and/or knife or anvil rolls, thereby insuring sufficient tension on the sheet. Air jets and/or vacuum ports may be incorporated into such elements as knife blades, shoes, knife and anvil rolls, and other rolls which guide the sheet. Optical sensors, microprocessors, and feedback controllers may be used to automatically control the apparatus and to coordinate the apparatus with the sheet forming apparatus and the processing apparatus. The intake area of the processing machine may be equipped with a vacuum conveyor or vacuum roll to assist in the transfer of the sheet to the processing apparatus. The vacuum may be used only during the transfer procedure, or it may be used continuously, for example to maintain the tension between the forming machine and the processing machine. The processing machine may also contain a vacuum conveyor or vacuum roll.

The components of the apparatus may be controlled by standard controlling equipment, microprocessors, and software. For example, the apparatus may be controlled and monitored with a standard programmable logic controller (PLC), such as an ALLEN-BRADLEY CONTROLOGIX CONTROLLER (PLC 5550) (ROCKWELL AUTOMATION, Milwaukee, Wis.). Individual apparatus may have separately controls, and these controls may be operably linked with the main control for the overall apparatus. For example, the winding apparatus may be controlled and monitored with a PanelMate Human Machine Interface (HMI) (EATON/CUTLER-HAMMER, Moon Township, Pa.). The HMI can control the starting, stopping, and other parameters that affect the formation, handling, and processing of the web. The HMI may interface to the PLC (Programmable Logic Controller) that actually controls the machine. It may be desirable to monitor the quality of the sheet without stopping production to remove a sample of the sheet. For example, a scanner or camera system may be used to image a portion of the web or the entire width of the web. Preferably, the handling apparatus avoids the necessary instrumentation, even if the instrumentation is positioned completely around the web (see generally 70 in FIGS. 11-13).

The handling apparatus may be used for a variety of sheet materials. For sheets of fibrous web material, the basis weight can be from about 10 grams/square meter (gsm) to about 500 gsm. Preferably, the basis weight is from about 25 gsm to about 200 gsm; more preferably from about 50 gsm to about 100 gsm. The speed of the sheet may be at least 30 meters per minute (m/min). Preferably, the speed of the web is at least 90 m/min; more preferably at least 150 m/min; more preferably still at least 300 m/min; more preferably still at least 400 m/min. A preferred sheet material is an air laid web having a width (i.e. cross-direction) of 108 inches (2.74 m); a basis weight of 55-65 gsm; less than 1% moisture; a caliper of 0.7-1.5 mm; a machine direction (MD) tensile of 3.0-6.0 kilograms per 3 inches (kg/3 in); a cross direction (CD) tensile of 4.3 kg/3 in; and a MD stretch of 5-10%.

The invention claimed is:

1. An apparatus for cutting and threading a sheet material, comprising:

a transfer blade having a retracted position and an extended position; and a pair of nip rolls;

wherein a sheet of material passing between the retracted position and the extended position is diverted away from a processing apparatus by passing between the nip rolls; and the movement of the transfer blade from the retracted position to the extended position directs the sheet toward the processing apparatus; and wherein the sheet is in contact with the nip rolls and the sheet moves at a first speed and is broken by a stress applied to the sheet by the rotation of the nip rolls at a second speed greater than the first speed.

2. The apparatus of claim 1, wherein the transfer blade comprises air jets.

3. The apparatus of claim 1, further comprising an idler nip roll, wherein the idler nip roll provides tension to the sheet when the sheet is in contact with the nip rolls or the transfer blade.

4. The apparatus of claim 1, wherein the sheet is a fibrous web.

5. The apparatus of claim 1, wherein the transfer blade and nip rolls are automatically controlled such that the sheet transfers between being directed toward the processing apparatus and being diverted away from the processing apparatus in a continuous manner.

6. An apparatus for cutting and threading a sheet material, comprising:

a transfer blade having a retracted position and an extended position; and a pair of nip rolls;

wherein a sheet of material passing between the retracted position and the extended position is diverted away from a processing apparatus by passing between the nip rolls; and the movement of the transfer blade from the retracted position to the extended position directs the sheet toward the processing apparatus; and wherein the sheet is in contact with the nip rolls and wherein the sheet moves at a first speed and is broken by a stress applied to the sheet by the combination of the movement of the transfer blade from the retracted position to the extended position and the rotation of the nip rolls at a second speed greater than the first speed.

7. The apparatus of claim 6, wherein the transfer blade comprises air jets.

8. The apparatus of claim 6, further comprising an idler nip roll, wherein the idler nip roll provides tension to the sheet when the sheet is in contact with the nip rolls or the transfer blade.

9. The apparatus of claim 6, wherein the sheet is a fibrous web.

10. The apparatus of claim 6, wherein the transfer blade and nip rolls are automatically controlled such that the sheet transfers between being directed toward the processing apparatus and being diverted away from the processing apparatus in a continuous manner.

* * * * *